United States Patent [19]

Negus, Sr.

[11] Patent Number: 4,736,885

[45] Date of Patent: Apr. 12, 1988

[54] POLYGONAL BULK CONTAINER

[75] Inventor: Fred W. Negus, Sr., 9919 Sherman Rd., Cedarburg, Wis. 53012

[73] Assignees: Fred W. Negus, Sr.; Fred W. Negus, Jr., both of Ft. Atkinson, Wis.

[21] Appl. No.: 41,675

[22] Filed: Apr. 23, 1987

[51] Int. Cl.[4] ..... B65D 5/36

[52] U.S. Cl. ..... 229/110; 229/41 C

[58] Field of Search ..... 229/110, 109, 41 C, 229/41 D, 183, 23 R, 23 BT, 23 A

[56] References Cited

U.S. PATENT DOCUMENTS

| | | | |
|---|---|---|---|
| 2,917,222 | 12/1959 | Frankenstein | 229/110 |
| 3,032,254 | 5/1962 | Wilson | 229/41 C |
| 4,146,169 | 3/1979 | Meyers et al. | 229/110 |
| 4,199,098 | 4/1980 | Lopez | 229/110 |
| 4,341,337 | 7/1982 | Beach, Jr. et al. | 229/41 C |

*Primary Examiner*—Willis Little
*Attorney, Agent, or Firm*—Alfred E. Miller

[57] ABSTRACT

A polygonal bulk container comprising a main body blank including a plurality of rectangular panels hingedly connected along hinge lines serialtim, a polygonal bottom panel having a majority of the side edges conforming to and abutting against the adjacent inner walls of said main body blank, a side edge glue flap hingedly connected to a margin of one of the rectangular panels, a bottom reinforcing tab with adhesive on the bottom surface thereof being foldable inwardly and glued to said polygonal bottom panel and functioning as a support therefor, and a polygonal auxiliary bottom panel in said container overlying said bottom reinforcing tab. The bottom tab and glue flaps together with adjacent extensions functioning to strengthen the bottom panel of the container against collapsing when transporting bulk food products.

6 Claims, 2 Drawing Sheets

POLYGONAL BULK CONTAINER

Bulk containers for the storage and transportation of frozen food products, such as ice cream, are known. However, it is desirable to provide a container formed of a single diecut blank of corrugated board that is high strength and anti-leak, and which can be folded and glued to form a polygonal container for the transportation and storage of bulk ice cream.

It is an object of the present invention to provide a container of high strength for storage and transportation of a bulk food product, as provided, with a bottom structure that resists leakage.

It is the further object of the present invention to provide a six-sided container with fold-over top margin portions for receiving a closure panel or cover.

It is the further object of the present invention to provide a bottom reinforcing panel which can be inserted in said container after set-up, and conforms to the polygonal shape of the interior of the box.

The present invention is directed to a single piece of corrugated board that can be set up in the form of a container by automatic machinery, and is provided with a main body consisting of six rectangular panels connected along hinge lines to form a six-sided container. The body is foldable along said hinge lines, while one edge panel is provided with a flap side edge that is glued to the other edge panel when the flat board is set up in the form of a six-sided box. The bottom of said single board is also provided with a bottom panel which is hinged to one of the median rectangular panels and is provided with angular marginal edges to form a six-sided bottom panel, having a bisecting score line. The board forming the container also contains locking tabs in the form of a web arrangement, as well as a glue tab depending from the bottom marginal edge thereof, so that when said board is folded in the form of a six-sided container, the tabs are glued together in two sets forming web constructions which, with said bottom panel, creates a high strength bottom for a container that receives and maintains bulk food items, such as ice cream.

In order that the present invention may be more clearly understood, it will now be disclosed in greater detail with reference to the accompanying drawings, wherein.

Figure 3:
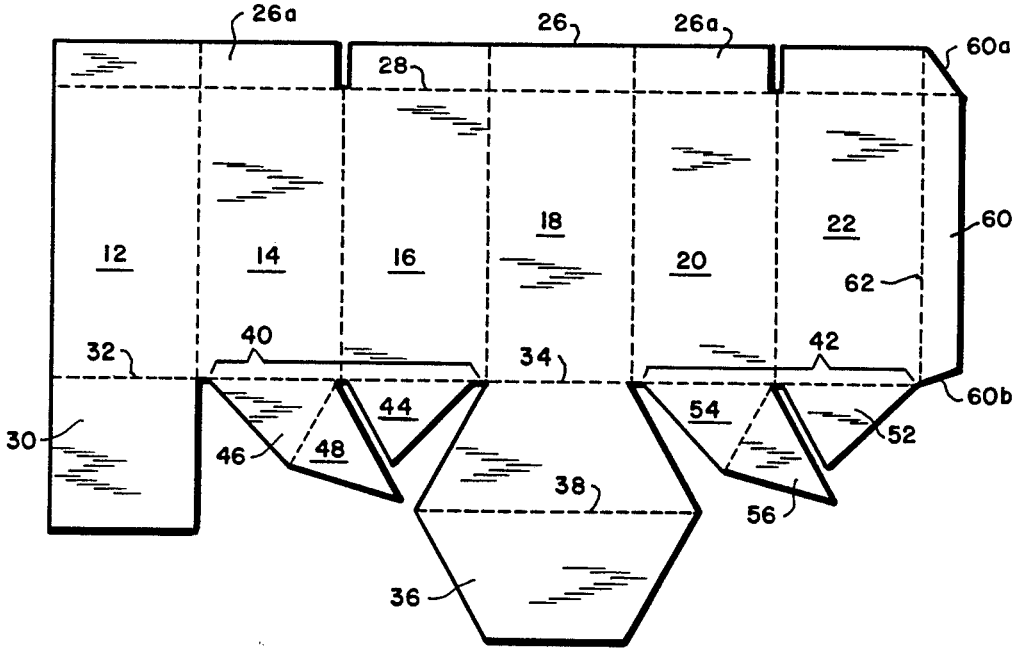
FIG. 3 is a top plan view of a blank from which the present container is formed.

Referring to the drawings, and especially FIG. 3 thereof, a flat blank of corrugated board, or any suitable cardboard, is shown in the form of a single piece referred to generally by the reference numeral 10 and having six rectangular panels 12–22 that are connected together along hinge lines 11. It should be observed that each of the rectangular panels 12–22 are provided with top edge flaps 26, which are connected to the respective panels along hinge lines 28.

From the bottom of the rectangular panel 12 is a depending bottom reinforcing square tab 30 connected to the rectangular panel 12 along the hinge line 32. Connected to panel 18, along hinge line 34, is a polygonal bottom panel 36, in which the present case is six-sided to conform to the configuration of the assembled and set up container. Scored fold line 38 bisects the bottom panel 36, as clearly seen in FIG. 3. Positioned on opposite sides of bottom panel 36 are web constructions referred to generally by the numerals 40 and 42, respectively. Web 40 consists of tab 44 as well as tab 46. The latter tab is provided with a score line 48 and a glue extension 50. Located on the opposite side of bottom panel 36 is web 42 constituted of tab 52 as well as separate tab 54 provided with a score line 56 which bisects the tab as well as a glue extension 58.

Finally, a side edge glue flap 60 is shown in FIG. 3 connected to rectangular panel 22 by means of hinge 62. The side edge glue flap is cut back at the top thereof at **60*a* and the bottom thereof at 60*b***, for purpose hereinafter described.

Figure 1:
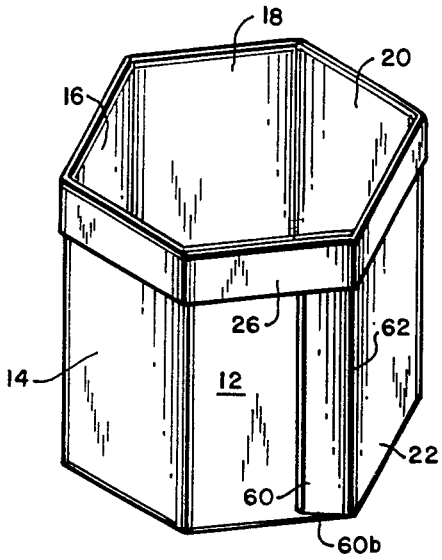
FIG. 1 is a perspective view of a set-up, six-sided bulk container constructed and assembled in accordance with the teachings of the present invention.
Figure 2:
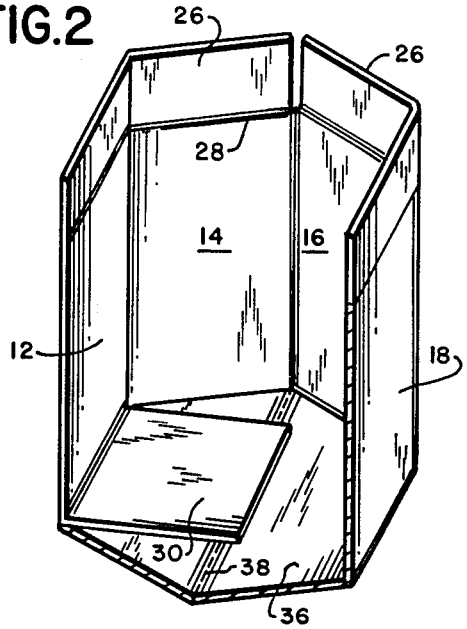
FIG. 2 is a perspective view of the bulk container shown in FIG. 1 and a partial, unassembled view having two side panels removed for purposes of clarity.

The container can be assembled from a flat blank to form a set up condition by means of folding and glueing which can be accomplished with automatic machinery, called post machines, of various types. On the other hand, the container may be assembled and set up manually, and when fully assembled, takes on the appearance of a six-sided bulk container, as seen in FIG. 1. In this connection, the rectangular panels 12, 14, 16, 18, 20 and 22 are assembled in a vertical position with a bottom reinforcing square tab 30 facing inward and between the vertically extending panels 12–20 surrounding said tab as seen in FIG. 2. It should be noted that bottom reinforcing square tab 30 is bent along the hinge line 32 in order to face inwardly between the rectangular panels 12–22 and is also provided with glue or other adhesive on the side facing the bottom of the container for a purpose hereinafter described.

The polygonal bottom panel 36 is then folded along the fold line 34 and inserted within rectangular panels 12–22 immediately below said bottom reinforcing tab 30, as seen in FIG. 2. Since the bottom panel 36 is provided with a scored fold line, the same may be bent and maneuvered into position so that the side edges of the bottom panel are complimentary and abut against all six side panels of the container construction. Since the underside of bottom reinforcing square tab 30 is provided with an adhesive, the same can be glued to the polygonal bottom panel 36 in order to reinforce the bottom structure of the container.

Figure 4:
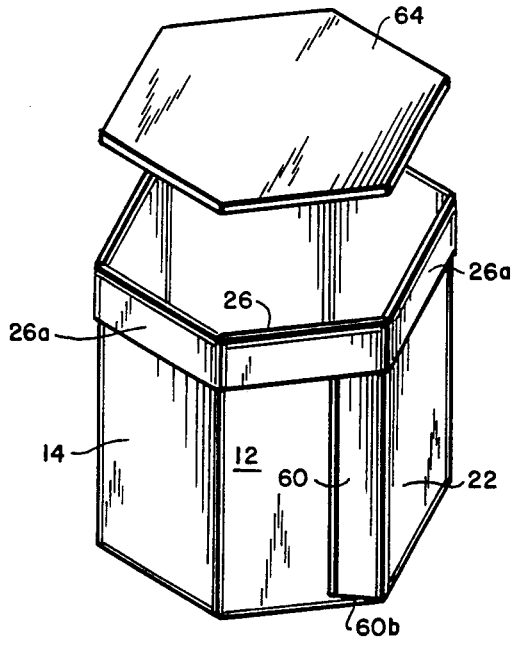
FIG. 4 is a perspective view of the six-sided bulk container similar to the view shown in FIG. 1, however showing the bottom floor insert removed therefrom.
Figure 6:
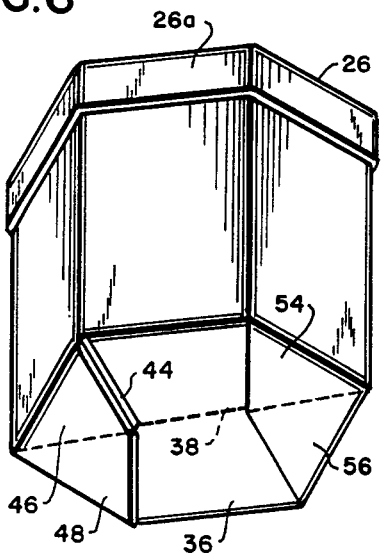
FIG. 6 is a perspective view of the bulk container as seen from the bottom thereof.

Each web 40 and 42 are now folded and glued in the manner to further reinforce the bottom structure of the container and render the same leak-proof. In this regard, when the rectangular panels are set up to form a six-sided container, tab 44 assumes a position such that it is directly glued to extension 50 of tab 46. Thus, extension 50 is glued to tab 44 resulting in a substantially diamond-shaped structure as shown in FIG. 6. The same method of assembly is applied to web 42 in which the tab 52 is moved to a position directly under glue extension 58 of tab 54. Thereafter, the extension 58 is glued to tab 52 forming another diamond-shaped structure as shown in FIG. 6 on an opposite side of the container. Of course, the fold lines 48 and 56, respectively, aid in the assembly of the container structure, especially in the automatic mode. After the rectangular panels 12–22 are set up to form a six-sided structure, and the bottom panel and reinforcing tabs and webs are assembled and glued, the side edge glue flap 60 is bent along hinge, 62 then glued to the opposite side edge of rectangular panel 12 shown in FIG. 3, and as seen in FIGS. 1 and 4. As seen in FIGS. 1 and 4, the cut-away sections **60*a* and 60*b* of the side edge glue flap 60 permits the side edge flap to be glued to the panel 12** without extending beyond the bottom or top surfaces of the container.

It should be apparent that the present embodiment of the invention discloses a bleached white surface of the inside of the container and a Kraft surface on the outside thereof. The inside of the container is required to be bleached white because of government sanitary regulations relating to the transportation and storage of food products. Consequently, the bleached white surface of the inside of the container also applies to the inside of the top edge flaps 26, which are shown in their stand-up position in FIG. 2. Consequently, the bleached white inside surfaces **26*a* of top edge flap 26 are folded over the top of the box as shown in FIGS. 1, 2, 4–6**, and are adapted to accommodate a six-sided removable cover for the container (not shown).

Figure 5:
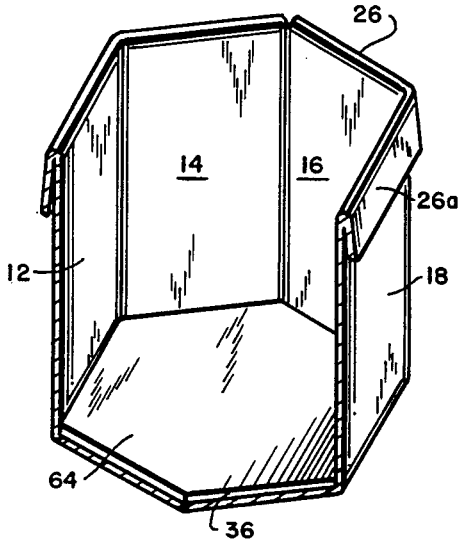
FIG. 5 is a perspective view of the assembled container with two front panels removed in order to view the bottom floor panel in its installed position.

In order to provide for a smooth bottom surface of the present bulk container, which is designed for the transportation and storage of ice cream and other food products, a six-sided auxiliary bottom panel may be used, as seen in FIGS. 4 and 5, wherein the bottom panel 64 conforms to the interior configuration of the container and is inserted through the open top of the bulk container and rests over the square bottom reinforcing tab 30.

The present six-sided die cut bulk food container can be assembled from a single knock-down blank to form a rugged container for bulk food items, such as meltable ice cream, and which is of high overall strength and is provided with a leak-resistent bottom construction. The container can be rapidly set up, folded and glued from a flat blank with a minimum of steps.

While the present invention has been disclosed and described with reference to a limited number of embodiments, it is apparent that variations and modifications may be made therein, and it is therefore intended to cover each variation and modification in the following claims within the spirit and scope of the invention.

What is claimed is:

1. A container for bulk food products comprising a main body blank including a plurality of rectangular panels hingedly connected along hinge lines seriatim, a side edge glue flap hingedly attached to a margin of one of said rectangular panels and adapted to be glued to the outside of the rectangular panel which is most remote from said one panel when said panels are folded along said hinge lines to form a polygonal-shaped tube, a polygonal bottom panel hingedly attached to the bottom edge of another one of said rectangular panels and adapted to be foldable inwardly within said tube, said polygonal bottom panel having a majority of the side edges conforming to and abutting against the adjacent inner walls of said main body blank, the rectangular panel to which said side edge glue flap is glued having a bottom reinforcing tab with adhesive on the bottom surface thereof being foldable inwardly to overlie and be glued to said polygonal bottom panel and functioning as a support therefor, a web on opposite sides of said bottom panel in which each is provided with a glue tab and an adjacent glue extension whereby said webs are folded inwardly underneath said polygonal bottom panel, a polygonal auxiliary bottom panel in said container overlying said bottom reinforcing tab, and each of said glue tabs is glued to an adjacent extension to thereby further support said polygonal bottom panel whereby said container functions as a receptacle for bulk food products without the panels in the interior of said container being exposed at side edges thereof, said rectangular-shaped bottom tab and glue tabs together with adjacent extensions functioning to strengthen the bottom panel of the container against collapsing when transporting said bulk food products.

2. A container as claimed in claim 1 wherein said polygonal-shaped bottom panel is provided with a score line bisecting said panel whereby said panel is slightly bendable in order to be easily foldable into the interior of said tube with the free edges thereof abutting adjacent panels.

3. A container as claimed in claim 1 wherein both said container and said bottom panel are six-sided.

4. A container as claimed in claim 1 wherein each of said glue extensions includes a first triangular part and a second triangular part and a score line therebetween, and one of said triangular parts being secured to an adjacent glue tab when the web is folded together.

5. A container comprising a main body blank including a plurality of rectangular panels hingedly connected along hinge lines seriatim, a side edge glue flap hingedly attached to a margin of one of said rectangular panels and adapted to be glued to the exterior surface of the rectangular panel which is most remote from said one panel when said panels are folded along said hinge lines to form a polygonal shaped tube, a polygonal bottom panel hingedly attached to the bottom edge of another one of said rectangular panels and adapted to be foldable inwardly within said tube, the rectangular panel to which said side edge glue flap is glued having a rectangular-shaped bottom reinforcing tab with adhesive on the bottom surface thereof being foldable inwardly to overlie and be glued to said polygonal bottom panel and functioning as a support therefor, a web on opposite sides of said bottom panel in which each is provided with a glue tab and an adjacent glue extension whereby said webs are folded inwardly underneath said polygonal bottom panel, and each of said glue tabs is glued to an adjacent extension to thereby further support said polygonal bottom panel and an additional polygonal-shaped floor panel which corresponds in dimensions and configuration to the interior of said container and is inserted within the assembled container resting on said bottom reinforcing tab whereby said container functions as a receptacle for bulk food products with no exposed edges of said panels in the interior thereof, said rectangular-shaped bottom tab and glue tabs together with adjacent extensions functioning to strengthen the bottom panel of the container against collapsing when transporting said bulk food products.

6. A container as claimed in claim 5 further comprising a plurality of top edge flaps that are foldable over the top edge of said container to be disposed on the extension of said container.

* * * * *